United States Patent [19]

Neal et al.

[11] 4,359,322

[45] Nov. 16, 1982

[54] DYEING PROCESS

[75] Inventors: Bobby L. Neal; Steven R. Lowman, both of Rock Hill, S.C.

[73] Assignee: Neal Chemical Company, Inc., Rock Hill, S.C.

[21] Appl. No.: 157,051

[22] Filed: Jun. 6, 1980

[51] Int. Cl.[3] ..... D06P 1/382; D06P 1/384; D06P 3/872

[52] U.S. Cl. ..... 8/532; 8/549

[58] Field of Search ..... 8/532, 549

[56] References Cited

U.S. PATENT DOCUMENTS

| | | | |
|---|---|---|---|
| 3,186,979 | 6/1965 | Hall et al. | 260/153 |
| 3,316,239 | 4/1967 | Riat et al. | 260/163 |
| 3,331,654 | 7/1967 | Husy | 8/532 |
| 3,545,910 | 12/1970 | Ong | 8/532 |
| 4,129,736 | 12/1978 | Begrich | 8/549 |
| 4,138,558 | 6/1979 | Orita et al. | 8/549 |

FOREIGN PATENT DOCUMENTS

| | | | |
|---|---|---|---|
| 743844 | 10/1966 | Canada | 8/532 |

OTHER PUBLICATIONS

Hall et al., Textile World, Aug. 1974, pp. 82–96.

Davis Jour. of Soc. of Dyes & Colorists, Mar. 1973, pp. 77–80.

Cook et al., Textile Chemist & Colorist, Nov. 1979, pp. 23–35.

Dolby, P. Theory & Practice of Dyeing Reactive Dyes on Cellulose.

Dolby, P. Amer. Dyestuff Reporter, Mar. 1976.

Neal, B. L. *Dyeing of Polyester/Cellulosic Blends with Various Dyes,* 4/20/77.

Hutchens, J. L., *Conserving Energy Through Selection of Dye Class & Methods of Application,* 12/12/79.

Neal, B. L., Synthetics Technical Brochure #2, 9/21/73.

Neal, B. L., Processing of Texturized Polyester in Both Yarn & Piece Goods Form, 10/19/1970.

*Primary Examiner*—Maria Parrish Tungol

*Attorney, Agent, or Firm*—Wellington M. Manning, Jr.; Luke J. Wilburn, Jr.

[57] ABSTRACT

A one bath dyeing process for dyeing cellulosic containing textile materials with fiber reactive dyestuffs, including polyester-cellulosic blends with disperse and fiber reactive dyestuffs. Material to be dyed is prepared for dyeing while avoiding residual chemicals that could retard dyeing. Dyestuffs and auxiliaries are added to the dye bath along with specified amounts of alkali and electrolyte and the materials subjected thereto at proper time-temperature relationships for level dyeing of a particular shade. Dye bath pH is maintained in a range of from about 8.0 to about 12.5 with total alkalinity being in a range of from about 1 to about 8 grams alkali per liter of dye bath. Electrolyte content in the dye bath is in a range of from about 50 to about 200 grams of electrolyte per liter of dye bath. For certain reactive dyestuffs, following the initial dye cycle, dye bath temperature is reduced, further alkali is added and a further short dye cycle is run to improve dye yield or wet fastness.

26 Claims, No Drawings

DYEING PROCESS

BACKGROUND OF THE INVENTION

This invention relates to an improved one bath dyeing process for the dyeing of cellulosic containing materials with fiber reactive dyestuffs including blends of polyester/cellulosic materials with disperse and fiber reactive dyestuffs.

Numerous processes have heretofore been utilized for the dyeing of textile materials such as yarns, fabrics and nonwovens with wide divergence among the process parameters, depending upon the particular material being dyed, and/or the particular type of dyestuff being employed. Of particular importance are processes that have been utilized to dye textile materials that are constituted from different types of raw materials, exemplified by polyester-cotton blends. With such blends, where the cellulosic ingredient is hydrophilic in nature and the polyester component is oleophilic in nature, different colorant systems are required for dyeing the two components. Specifically, different classes of dyestuffs are necessary for the proper dyeing of cellulosic materials than for the proper dyeing of polyester materials with attendant variance in dyeing process conditions. Conventionally, dyers utilize a two bath system for dyeing polyester-cotton blends in which the polyester component is first dyed in a bath containing disperse dyestuffs, after which the textile material is rinsed, the dyestuff cleared, and the cotton component thereafter dyed in a subsequent bath containing fiber reactive colorants. Subsequent to the separate dyeing of the two components, the material is rinsed and subjected to further normal processing steps. Such a two bath procedure is in widespread use today, even though certain further dyeing techniques have been developed as alluded to hereinafter.

In utilizing the conventional two bath process, not only is the dyeing operation expensive and time consuming, but the process is particularly energy intensive. With different baths, substantial energy is expended for raising the bath temperature from ambient to elevated temperature conditions at several intervals during the process. Moreover, large amounts of dyestuffs and auxiliaries are needed to achieve desired yields, considerable rework is necessary due to shade variability and unlevel dyeings due to strike rate of reactives, and the protracted length of time required to complete dyeing by the two bath process reduces the production capacity of the dyeing equipment.

Presently, the availability of energy adequate to run energy intensive commercial processes, including dyeing operations is of major concern, not to mention the vastly increased cost of same. Consequently mush effort has been devoted to improving commercial processes, including dyeing, attempting to reduce energy requirements necessary for the dyeing of all materials, particularly polyester-cotton blends which are notoriously expensive and time consuming using state of art techniques. One relatively new process for dyeing polyester-cotton blends involves the addition of disperse and reactive dyestuffs capable of dyeing both the polyester and the cotton, along with necessary auxiliaries, into a single dye vat where the polyester component of the material is first dyed under acidic conditions. Thereafter temperature of the dye bath is reduced and electrolyte and alkali are added to the bath to raise the pH and salt content for dyeing of the cellulosic component with the already present fiber reactive dyestuffs. This particular one bath, two stage process, though representing improvement over the conventional two bath process, is very limited as to dyestuffs that may be employed therein, and does not represent a truly significant improvement over the two bath process insofar as energy requirements are concerned. Particularly, a very limited selection of fiber reactive dyestuffs may be used in the particular process, commonly referred to as the "hot dyers".

A further process that has been developed, attempting to improve economics of the dyeing of textile materials constituted from cellulosic and non-cellulosic blends is referred to as RID (Rapid Inverse Dyeing). The rapid inverse dyeing process is particularly directed to the dyeing of polyester-cotton blends. In this process, the cotton component is dyed first with fiber reactive dyestuffs after which the bath is dropped, the material rinsed, and a second bath is prepared with disperse dyestuffs in which the polyester is then dyed. Rapid inverse dyeing requires a shorter dye cycle, and is less energy intensive than either the conventional two bath system or the one bath, two stage system, both of which are set forth above.

The present invention represents an improvement over all of the prior art processes discussed above. A true one bath dyeing system is provided, the parameters of which permit successful dyeing of 100% cellullosic materials and polyester-cellulosic blends. Blends may be dyed with disperse and fiber reactive dyestuffs, while the 100% cellulosic material is dyed with fiber reactive dyes. While there is wide general variation in preferred dyeing techniques for the various subgroups of fiber reactive dyestuffs (identified hereinafter), with very minor exception, known fiber reactive dyestuffs may be employed in the present process with some slight variation in process parameters, the result of which enables one to achieve particularly level dyeing, excellent yield and good dye fastness. In fact, the present process permits uniform dyeing with certain shades that heretofore has been very difficult to dye by the conventional two bath process, except with substantial reworking, and even then poor wet fastness was present.

In general, the one bath process according to teachings of the present invention is neither taught nor suggested by the known prior art, and has the following attendant advantages: (a) reduced dye cycle time, and thus greater productivity from the dyeing equipment; (b) decreased labor cost/overhead due to increased production; (c) substantial reduction in the energy utilized; (d) increased yield for many fiber reactive dyes, especially when dyeing selected dark or heavy shades; (e) less time involved for dye add cycles, if needed; (f) more level dyeing; and (g) less dyestuff required in most cases.

SUMMARY OF THE INVENTION

It is an object of the present invention to provide an improved process for dyeing cellulosic containing materials with fiber reactive dyes.

It is another object of the present invention to provide an improved process for the dyeing of polyester-cellulosic blends from a one bath process.

Still further another object of the present invention is to provide an improved process for the dyeing of cellulosic-polyester textile materials from a one bath process, utilizing fiber reactive dyestuffs for the cellulosic materials and disperse dyestuffs for the polyester materials.

Yet another object of the present invention is to provide an improved one bath dyeing process that is suitable for all types of fiber reactive dyestuffs.

Generally speaking, the dyeing process for cellulosic containing materials according to teachings of the present invention includes the steps of scouring the textile material to render same suitable for dyeing while avoiding residual materials that will interfere with dyeing; rinsing the material; souring the material with a suitable acid whereby alkali from the scour operation is neutralized and the material is rendered slightly acidic; providing a chlorine free dye bath; adding a suitable dye assist system into the dye bath, which is stable to high alkali and high electrolyte content; adding appropriate electrolyte and alkali to the bath to provide from about 50 grams per liter to about 200 grams per liter of electrolyte, a bath pH from about 8.0 to about 12.5, and a bath total alkalinity that permits proper exhaustion and level dyeing; adding a predetermined dyestuff formulation to the dye bath to achieve a desired shade, said dyestuff formulation comprising at least one fiber reactive dyestuff; subjecting said material to said dye bath at a predetermined time-temperature relationship to dye said material to said desired shade; and thereafter rinsing and scouring said material.

More particularly, the process according to the present invention is equally suitable to the dyeing of 100% cellulosic materials or blends of polyester and cellulosic containing materials such as polyester-cotton, where when dyeing a blend, a disperse dyestuff is included for dyeing the polyester which dyestuff should not be sensitive to high pH, and further the bath contains a carrier system for the disperse dyestuff that is stable to high electrolyte content and high pH.

In dyeing 100% cellulosics or polyester-cellulosic blends according to teachings of the present invention, a significantly shorter dye cycle from pre-scour through after-scour is realized, whereby significantly less energy is required for the overall system, and whereby less labor is utilized per pound of goods processed. Such of course reduces the overll cost of the dyeing operation, raises the dye capacity of the production equipment, and utilizes less raw material from the standpoint of water. Additionally, and very importantly, better dye yields and more level dyeing are obtained by virtue of the present process which reduces the amount of dyestuffs in most cases. In like fashion, the number of reworks is usually reduced by virtue of the fact that the desired shade can be more easily achieved during the initial strike. All of the above lead to drastic improvement in the dyeing process for disperse-fiber reactive dyeing operations as well as the dyeing of 100% cellulosics with fiber reactive dyestuffs.

While the general parameters of the process of the present invention are operable for generally all fiber reactive dyestuffs, depending upon the type of fiber reactive dyestuff that is being employed, preferred process conditions vary. For example, bath pH and electrolyte content are preferably controlled within certain limits for different groups of fiber reactive dyestuffs. Particular reactive dyestuffs are categorized in certain groups as specified hereinafter. For group A fiber reactive dyestuffs, it is preferred that the electrolyte content be in a range of from about 100 to about 140 grams of electrolyte per liter of bath while the bath pH is preferably in a range of about 8.3 to about 9.5. For group B dyestuffs, the preferred electrolyte content is from about 140 to about 160 grams per liter, while the bath pH is preferably in a range of 8.3 to about 10.5. For group C dyestuffs, the preferred electrolyte content is in a range of from about 140 to about 160 grams per liter, while the bath pH is preferably in a range of from about 10.0 to about 11.2. For group E dyestuffs, the electrolyte content is preferably in a range of from about 140 to about 160 grams per liter while the dye bath pH is in a range of from about 10.0 to about 11.2. Dyeing with group E reactive dyestuffs, improved yield can be achieved by lowering the dye bath temperature after the normal dye cycle, to a temperature of about 160° F., adding further alkali thereto, and running for a further period, preferably about 30 minutes. For group D dyestuffs, the same process conditions are preferred as with group B, i.e., an electrolyte content in a range of from about 140 to about 160 grams per liter, and a bath pH of from about 8.3 to about 10.5. Wet fastness has been considered to be notoriously poor for group D dyes. It has been determined, however, that if the bath temperature is reduced to about 180° F. after the normal dye cycle and further alkali added, the group D dyes will become fixed to the substrate in superior fashion, leading to vastly improved wet fastness.

In practice of the process of the present invention, utilization of materials that are stable to high electrolyte content and high pH is very important. The one bath system permits simultaneous dyeing of the cellulosic and polyester components of the materials being dyed. For example, while providing a dye bath pH adequate to permit the dyeing operation to proceed, total alkalinity of the bath is maintained at a level low enough to preclude a fast strike of the fiber reactive which could lead to unlevel dyeing. In fact, migration of the fiber reactive dye will continue to occur even at the boil, resulting in mush more level dyeing and a much greater probability that the proper dye shade is obtained initially than with conventional dyeing, except for group E dyes where the further alkali is added. In the event, however, that the proper shade is not first achieved, a dye add cycle is permitted according to the present process that also is generally much shorter than conventional adds. According to the present process, it is only necessary to reduce temperature of the dye bath to approximately 160° F., add the further dye formulation to the bath along with alkali and electrolyte, if necessary, heat to the boil and run for about twenty minutes. Such is permitted due to the low total alkalinity of the dye bath. In those situations, i.e., group D, any dye add should be made prior to the addition of the further alkali, for it is the high total alkalinity, high electrolyte content along with the high bath temperature that necessitates reduction of dye bath temperature to approximately 80° prior to making a dye add in prior art processes. Dye adds for group E dyestuffs after the further alkali addition must therefore follow conventional dye add techniques.

Any dye liquor to material ratio may be utilized to practice the process of the present invention with the additives specified hereinafter being tailored to same. For beck operations, it is preferable that a dye liquor to material ratio be maintained in a range of from about 15 to about 20 to 1, while for jet dyeing, the preferred ratio is approximately 10 to 1. While hereinafter the materials being referred to are 100% cotton fabrics or 50/50 polyester-cotton blend fabrics, other cellulosic and blend arrangements may be utilized with appropriate modification of dyestuffs and auxiliaries, depending upon the particular relationship of polyester component to cellulosic component.

DESCRIPTION OF THE PREFERRED EMBODIMENTS

In general, the process of the present invention is directed to dyeing operations in which fiber reactive dyestuffs are employed to dye cellulosic containing materials, either 100% cellulosic materials such as cotton, rayon, flax, linen, jute and the like, or blends of polyester with cellulosic components such as polyester-cotton blends. The term polyester as utilized herein includes, without limitation, synthetic materials that are represented by the reaction products of a dicarboxylic acid, or ester forming derivatives of same, e.g., dimethyl terephthalate condensed with a glycol, e.g., ethylene glycol to provide a polymer of the glycol ester of the dicarboxylic acid. Generally, the polyesters are polyethylene terephthalate and modified polyethylene terephthalates. The polyester-cellulosic components may be represented by separate strands, filaments or the like that are thereafter unified into a woven, knitted, nonwoven or other structure, the components may be blended together prior to spinning and dyed as a yarn, or fabric, etc.

Materials to be dyed according to the present process are prescoured to remove dirt, wax, knitting emulsions and other materials to generally clean the material while avoiding utilizing chemical systems that will leave residual components which could have a retarding effect on dyeing. Thereafter, the scoured material is rinsed and subjected to an acid sour to neutralize any alkali from the prescour operation and to render the material slightly acidic whereby pH in the dye bath can be controlled without danger of premature exhaustion of dyestuffs. Subsequent to the acid sour, the material is tested for residual alkali, which is neutralized if found present.

Insofar as the dye bath is concerned, a low liquor volume is preferred, preferably in a liquor to material weight ratio range of about 15 to from about 20 to one for beck dyeing and about 10 to one for jet dyeing. The dye bath water is tested for the chlorine which, if present can reduce dye fastness as well as yield for certain fiber reactives. It is highly preferred that the bath be chlorine free for proper overall operation. In the event chlorine is found present, sodium thiosulfate, preferably, is added to the bath as an antichlor. Once the bath is free of chlorine, bath temperature is adjusted, if necessary, to a range of from about 80° F. to about 120° F. and the chemical additions are made.

There is no critical order of addition of chemicals, though preferably dye assist and carrier systems are first added followed by electrolyte and alkali. Thereafter the dyestuff formulation is added and materials to be dyed are then held in the dye bath at a predetermined temperature time relationship to achieve level dyeing of the desired shade. In certain circumstances as will be specifically discussed in detail hereinafter, following the normal dye cycle, dye bath temperature is reduced to approximately 160° to 180° F., additional alkali is added and the run time continued for about 30 minutes. Depending upon the particular dyestuff being utilized dye yield or wet fastness is improved.

Subsequent to dyeing, the materials are rinsed, scoured, rinsed and dried, after which the then dyed materials are further processed as intended.

While some of the above noted process steps are basically conventional, certain ingredients and/or certain conditions for these steps may either be critical or highly preferred. As such, each of the general process steps will be described with specific detail, alluding as to each, any criteria that could adversely affect the dyeing operation, or that is preferred or critical.

Pre-Scour. Specifics of the pre-scour operation are basically dictated by the color shade that is desired. When dyeing dark and dull shades, it is preferred that the scour is shorter, whereby less time is consumed, and rinsing may be easier, whereas, when dyeing extremely bright or pastel shades, it is preferred to both scour and bleach the goods to a sufficient degree of whiteness that the desired shade can be easily obtained. Principally the pre-scour operation is conventional in the art and may employ any particular chemicals that will properly prepare the material for dyeing, i.e., adequately remove any oils, waxes, dirt, and the like which could resist fixation of the dyestuff or otherwise interfere with the dyestuffs per se or the level and uniform dyeing of the material. For example, many non-ionic materials though suitable for scouring in general, leave residual chemicals that retard the dyeing operation. Anionic materials are not generally fraught with such problems and are preferred. Generally speaking, alkaline materials such as soda ash and caustic are employed in the prescour operation along with various soaps, solvents and the like. When a scour-bleach operation is conducted, hydrogen peroxide or some other bleach is also included, preferably along with an appropriate stabilizer for the bleach. The type of contaminants to be removed during prescour will dictate the particular scour chemical selection.

The various chemicals are added to the scour bath at approximately 100° F. bath temperature, after which bath temperature is raised at a rate of 3° to 10° F. per minute to a temperature in a range of about 200° F. to about 212° F. and held for about 30 to 45 minutes. Proper wet out of the material is tested, and if appropriate, the bath is cooled and the material rinsed well to remove residual alkaline materials.

Acid Sour. Subsequent to rinsing of the pre-scoured and/or pre-scoured and bleached materials, the dye vat is returned to a proper water level and the water is heated to about 100° F. A mild acid, such as acetic acid, is added to neutralize any alkali and to render the material to be dyed slightly acidic. Such is accomplished by heating the bath after addition of the acid to about 120° F. and running for about 10 minutes. Preferably, acidity of the bath is in a pH ranging of from about 5.5 to about 6.0. An indicator, such as Necco-Indicator OBS, manufactured by Neal Chemical Company, Rock Hill, S.C. may be employed to check pH of the bath. While the acid sour step could be eliminated with multiple rinses or the like, such is much preferred.

Subsequent to the acid sour, when the pH of the bath and the material are appropriate, the bath is dropped and the vat refilled to the low water level. Bath temperature should preferably be in a range of from about 80° F. to about 120° F. primarily for good solubility of electrolyte, though if desired, the dye bath could be at a lower temperature initially, and the temperature raised later at the time of electrolyte addition, or just prior to dyeing. The bath water is then checked for chlorine content since it is highly preferred, depending upon the sensitivity to chlorine of the reactives utilized, that the dye bath be free of chlorine. A small number of fiber reactive dyestuffs are not sensitive to chlorine and for these dyestuffs, chlorine in the dye bath will not retard dyeing. Again, the chlorine content of the water may be rapidly checked utilizing an indicator, such as Necco-Chlorine Indicator, supplied by Neal Chemical Company, Rock Hill, S.C. If chlorine is detected, 100 to 150 grams of an antichlor, such as sodium thiosulfate per 2,000 gallons of water is added to the bath. Antichlors that could adversely affect chlorine senstive reactive dyes should be avoided, however, such as sodium bisulfite. In general, it is easier to provide a chlorine free bath at all times rather than test dyestuffs for chlorine stability, whereby a standardized procedure is possible.

Chemical Addition to Dye Bath. In dyeing operations where both disperse and fiber reactive dyestuffs are present, a dye carrier system and a dye assist system are added to the bath, though the dye carrier may be omitted when only dyeing with fiber reactive dyestuffs. The dye carrier system generally includes a solvent phase and emulsifiers. The particular ratio of solvent phase to emulsifiers may vary, depending upon the intended use of the particular carrier. Carriers for beck dyeing, for example, contain a greater percentage of emulsifier than do carriers for jet dyeing operations because of the action of the dye liquor and foaming propensity in jet dyeing. For the present one bath dye process, it is preferred that dye carrier systems for beck or package dyeing include approximately 90 to 70 percent solvent phase and 10 to 30 percent emulsifiers, while for jet dyeing, approximately 93 to 80 percent solvent phase is utilized in conjunction with 7 to 20 percent emulsifiers.

The particular solvent components of carrier system are not critical so long as they accomplish the intended function, are stable at high electrolyte content and high pH, and do not adversely affect dyeing with the particular dyestuffs involved. A blend of solvents is preferred. Some solvents, for example, are absorbed by the fiber, swell the fiber and promote good dye yield, but comparatively reduce leveling and/or dye migration. Exemplary of these absorbable solvents are trichlorobenzene and orthophenyl phenol. Conversely, other solvents are not absorbed in the fashion as those mentioned above, and while they do not promote excellent dye yield, they do offer excellent leveling and/or dye migration characteristics. Examples of this type of solvent are methyl benzoate, butyl benzoate, methylparatoluate benzoate, and the methyl ester of cresoic acid. A blend of these two types of solvents may thus be utilized to promote yield, good leveling and good dye migration, and thus is preferred. Chlorinated hydrocarbons should be used in limited amounts since chlorinated products tend to retard dyeability of fiber reactive dyes.

Exemplary of solvents that are suitable for use in carrier systems according to teachings of the present invention include perchloroethylene, trichlorobenzene, monochlorobenzene, orthochlorotoluene, monochlorotoluene, orthodichlorobenzene, biphenyl, methyl biphenyl, methyl benzoate, butyl benzoate, methylparatoluate benzoate, dibutyl maleate, benzyl benzoate, varsol, high flash naphtha, toluene, diallyl phthalate, dimethyl phthalate, dimethyl terephthalate, orthophenyl phenol, pseudocumene, benzoic acid, methyl naphthalene, xylene, methyl salicylate, diphenyl oxide, and methyl cresotinate.

The emulsification system for any dye carrier is somewhat critical, and even more so in dyeing with a one bath system as taught by the present invention. For example, the emulsification system must be stable to both an alkaline pH and to large amounts of electrolyte, and must emulsify the solvent phase of the carrier while avoiding adverse effects on dyeability. In a preferred arrangement, a blend of emulsifiers is utilized which includes both hydrophilic and lipophilic emulsifiers.

Exemplary of emulsifiers that are suitable for use according to teachings of the present invention include, without limitation, ethylene oxide nonylphenols, ethylene oxide consensates, polyethylene glycols, amine condensates, alkyl and glycol esters, glycerol esters, alkanolamides, glycols, such as hexylene glycol, ethylene glycol, propylene glycol, diethylene glycol and the like, soaps formed by the reaction of a strong alkali with a mixture of a fat and an acid, sulfonated castor oils, sulfonated red oil, sorbitan fatty acid esters, ethoxylated sorbitan esters, ethoxylated fatty acids, ethoxylated alcohols, ethoxylated triglycerides, ethoxylated fatty amines, dodecyl benzene sulfonic acid and modified forms of same, sodium di-2-ethyl hexyl sulfosuccinate, alkyl aryl sulfonates, alkoxylated aromatics, polyoxypropylene/polyoxyethylene condensates, and synthetic alcohol alkoxylates.

In addition to the dye carrier system, dye assists are further added to the dye bath which are stable at the alkaline pH and high electrolyte content. The dye assist aids in penetration of the cellulosic fiber, reduces the amount of fiber reactive color build up on the surface of the fiber, aids in minimizing crack marks, chafe marks and the like, assists in leveling of the dispersed dyestuffs, and due to excellent dispersing characteristics, aids in preventing agglomeration of the disperse dyes. Known dye assists may be utilized that meet the above criteria, as exemplified without limitation by sulfonated castor oil, sulfonated sperm oil, soaps, phosphated nonyl phenols, amine condensates, reacted forms of polyethylene glycols, and various blends of same. It is preferred to use a blend of ingredients such as a blend of low foaming, anionic surface active agents of sulfated oils; triethanolamine; soaps, such as those prepared from a fat of a distilled coconut oil, oleic acid and potassium hydroxide; isopropyl alcohol; amine-coconut oil condensates, and a neutralized, free acid form of a phosphated 9-mole ethylene oxide nonylphenol.

The amount of carrier and dye assist to be added to the dye bath should be that amount necessary to permit proper exhaustion of the dyestuffs from the bath for a good yield while avoiding unlevel dyeings and avoiding dyeings without proper fixation of dyestuff to the material being dyed. Dye assist is preferably added to the dye bath in a range of from about 0.5 to about 3.0 weight percent based on the bath weight while the carrier is preferably added in an amount in a range of from about 1.5 to about 5.0 weight percent for jet dyeing and from about 2.5 to about 12.0 weight percent for beck and package dyeing.

As mentioned above, the dye bath for practice of the process of the present invention is maintained at an alkaline pH while avoiding a high total alkalinity that could bring about hydrolysis of dyestuff. Overall total alkalinity of the dye bath is preferably maintained in a range of from about 1 to about 8 grams alkaline material per liter of bath, though by selection of weak alkaline material, even up to about 20 grams per liter may be employed for certain dye shades, with pH being maintained within a particular preferred range, depending upon the group of the fiber reactive dyestuff used. A pH in the lower part of the various ranges is preferred. In general, certain alkaline materials per se and combinations of an alkaline material and a mild acid to obtain a proper pH and total alkalinity may be utilized as exemplified by caustic soda, potash, sodium silicate, trisodium phosphate (TSP), soda ash, tetrasodium pyrophosphate (TSPP), sodium tripolyphosphate, borax, disodium phosphate, sodium bicarbonate, sodium hexametaphosphate, and monosodium phosphate (MSP). Particular preferred alkaline systems are set forth below in Table I.

Dye bath pH for the one bath system according to the present invention should fall in a range of from about 8.0 to about 12.5, preferably from about 8.3 to about 11.2. While the fiber reactive dyestuffs will exhaust throughout this full range, the various groups of fiber reactive dyestuffs perform best within certain, limited pH ranges. For example, group A reactive dyestuffs perform best in a range of pH from about 8.3 to about 9.5; group B from about 8.3 to about 10.5; group C from about 8.8 to about 11.2; group D from about 8.3 to about 10.5; and group E from about 10.0 to about 11.2. Even so, pH within the broad range, or the more preferred ranges for the various groups of dyestuffs should be achieved with a minimum amount of total alkali in the bath. Such is preferably achieved by utilizing an alkaline material that has a constant pH or by using a combination of one or more alkaline materials and mild acids to provide a buffer system. For example, Table I sets forth relative amounts of alkaline materials and mild acids to achieve the particular pH range specified for the various groups of reactive dyestuffs.

TABLE I

Preferred Alkali System Additions

| | Group of Fiber Reactive Dyestuff | | | | |
|---|---|---|---|---|---|
| | A | B | C | D | E |
| I. Soda Ash, g/l | 0.30 | 2.00 | 5.50 | 2.00 | 5.50 |
| Sodium Bicarbonate, g/l | 1.00 | 1.00 | 1.50 | 1.00 | 1.50 |
| II. Soda Ash, g/l | 0.00 | 2.00 | 4.00 | 2.00 | 4.00 |
| Borax, g/l | 3.00 | 2.00 | 1.00 | 2.00 | 1.00 |
| III. Soda Ash, g/l | 1.00 | 2.00 | 5.00 | 2.00 | 5.00 |
| MSP, g/l | 1.00 | 0.30 | 1.00 | 0.30 | 1.00 |
| IV. TSPP, g/l | 0.50 | 2.00 | | 2.00 | 5.00 |
| Sodium Bicarbonate, g/l | 1.50 | 1.00 | | 1.00 | 0.30 |
| V. TSP, g/l | 0.50 | 2.00 | 4.00 | 2.00 | 4.00 |
| Borax, g/l | 3.00 | 2.00 | 1.00 | 2.00 | 1.00 |
| VI. TSP, g/l | 1.00 | 2.00 | 5.00 | 2.00 | 5.00 |
| MSP, g/l | 1.00 | 0.30 | 1.00 | 0.30 | 1.00 |
| VII. TSP/g/l | | | 5.00 | | |
| Sodium Bicarbonate | | | 1.50 | | |

The alkali systems as set forth in Table I are preferably dissolved in approximately 100 to 150 gallons of water at a temperature in a range of from about 140° to about 160° F., after which the alkali solution is added to the dye bath, while avoiding direct contact with material being dyed.

As discussed above, when dyeing with group D and E dyes, the present process is preferably a one bath, two step process where once initial dyeing is complete, the dye bath is cooled and further alkali is added to the dye bath for a continued dyeing period. The preferred add of additional alkali for group D dyes is a blend of from about 10 to about 15 grams per liter soda ash and from about 0.5 to about 1 gram per liter caustic soda (50%), and from about 7.5 to about 10.0 grams per liter soda ash, and from about 1.0 to about 1.5 grams per liter of a 50 percent solution of caustic soda for group E dyestuffs. The alkali is well diluted and slowly added to the dye bath, after which the bath is held for about 30 minutes at a temperature in a range of about 180° F. (group D) and from about 140° F. to about 160° F. (group E). The addition of alkali add increases dye yield of the group E dyes, but should not be initially added to the dye bath. With the group D dyestuffs, the subsequent step of alkali addition is made once the correct shade is attained, for the purpose of obtaining maximum dye fixation on the substrate. Depending upon the particular dyestuffs employed therefore, the alkaline add in the second or subsequent step is generally a mixture of from about 7.5 to about 15 grams per liter soda ash, and from about 0.5 to about 1.5 grams per liter of a 50 percent solution of caustic, which is added slowly in dilute form to the bath, after which the bath is run for 30 additional minutes at a temperature in a range of from about 140° F. to about 180° F.

Electrolyte content of the dye bath is likewise important in the one bath dyeing process of the present invention. The amount of electrolyte or salt being added to the dye bath is extremely critical, as well as the type of salt or electrolyte to some lesser degree. Either glauber salt (sodium sulfate) or common salt (sodium chloride) are generally employed. Glauber salt is preferred when dyeing light to medium shades and to group A and B dyestuff since the rate of exhaust with glauber salt is not as great as with common salt. Common salt may, however, be utilized for all fiber reactive groups. Further, it has been determined that the high amounts of glauber salt do not tend to alter pH of the dye bath to any appreciable degree whereas a drop in pH (generally 0.2–1.0) occurs when common salt is employed.

Electrolyte is added to the dye bath preferably subsequent to the alkaline solution addition, and in a general range of from about 50 to about 200 grams per liter of dye bath, and preferably from about 110 to about 160 grams per liter. As with pH, there is a preferred range of electrolyte content for the various groups of fiber reactive dyestuffs. Group A fiber reactive dyestuffs will dye satisfactorily with an electrolyte content of from about 110 to about 140 grams of electrolyte per liter of dye bath, while all the groups of dyestuffs perform best at an electrolyte content in a range of from about 140 to about 160 grams per liter. The electrolyte content of the dye bath may be readily ascertained by utilizing a hydrometer to determine specific gravity of the solution. When utilizing a Fisher hydrometer 11605EA, the group A electrolyte concentrations will produce a hydrometer reading in a range of from about 34.5 to about 39.8, while the groups A, B, C, D and E preferred concentrations will register hydrometer readings in a range of from about 42.0 to about 45.5.

In selecting particular dyestuffs that are suitable for use in practice of the process of the present invention, the two general types will be discussed, namely the disperse dyestuffs for dyeing the polyester component, when a polyester-cellulosic blend is being dyed, and the fiber reactive dyestuffs for dyeing cellulosic materials. Generally speaking, all disperse dyestuffs can be dyed at a pH in a range of from about 3.5 to about 5.0. At pH levels less than 3.5 and, higher than 5.0, certain of the disperse dyes undergo hydrolysis and/or shade change. Once a dye is hydrolized, the reaction is irreversible. It is possible to correct a shade change that is not caused by hydrolysis by converting the color back to the original shade with certain well known techniques.

Disperse dyestuffs have been thoroughly evaluated for sensitivity to pH and are listed in Table II. In Table II, dyestuffs are indicated as sensitive to pH (Yes), not sensitive to pH (No), or as exhibiting a shade change not due to hydrolysis (SC).

TABLE II pH Sensitivity of Disperse Dyestuffs

| Dyestuff Common Tradename | C.I. If Available | Sensitivity |
|---|---|---|
| Bucron Yellow 2GR | Not Available | No |
| | Disperse Yellow 23 | No |
| Bucron Yellow RW | Disperse Yellow 42 | No |
| Latyl Yellow 3G | Disperse Yellow 54 | No |
| Bucron Yellow 3GNS | Disperse Yellow 64 | No |
| Latyl Yellow GFSW | Disperse Yellow 67 | No |
| Eastman Polyester Yellow 6GLSW | Disperse Yellow 88 | No |
| Resolin Brilliant Yellow 7GL | Disperse Yellow 93 | Yes |
| Terasil Brilliant Yellow 6G | Disperse Yellow 99 | No |
| Samaron Yellow 6GSL | Disperse Yellow 114 | No |
| Resolin Yellow GLS | Not Available | No |
| Bucron Brilliant Orange RNS | Not Available | SC |
| Genacron Orange RSE | Not Available | No |
| Bucron Orange LB | Disperse Orange 5 | Yes |
| Terasil Orange 2GR | Disperse Orange 25 | No |
| | Disperse Orange 30 | No |
| Latyl Orange 2GFS | Disperse Orange 44 | No |
| Palanil Orange 4G | Disperse Orange 55 | No |
| Terasil Brilliant Orange 2RL | Disperse Orange 56 | No |
| Bucron Brown Y | Disperse Orange 62 | No |
| Resolin Orange 3GL | Disperse Orange 66 | No |
| Bucron Rubine 2BNS | Not Available | Yes |
| Bucron Brilliant Red BNS | Not Available | SC |
| Bucron Red YNS | Not Available | SC |
| Bucron Red MLNS | Not Available | SC |
| Amacron Red YLS | Disperse Not Available | No |
| Bucacel Pink RF | Disperse Red 4 | SC |
| Esterophile Light Red RBL | Disperse Red 44 | No |
| | Disperse Red 55 | No |
| | Disperse Red 59 | No |
| Resolin Red FB | Disperse Red 60 | SC |
| Sodyecron Scarlet 2R | Disperse Red 68 | SC |
| Foron Rubine SE-GFL | Disperse Red 73 | No |
| Resolin Red BBL | Disperse Red 82 | Yes |
| Resolin Red RL | Disperse Red 90 | Yes |
| Palanil Pink REL | Disperse Red 91 | SC |
| Palanil Red BEL | Disperse Red 92 | SC |
| Resolin Scarlet 3GL | Disperse Red 106 | No |
| Latyl Ruby Red BRFS | Disperse Red 140 | No |
| Terasil Brilliant Red 4G | Disperse Red 151 | No |
| Resolin Brilliant Red BLS | Disperse Red 159 | SC |
| Bucron Red KTNS | Similar to Red 177 | SC |
| Sodyecron Red AYLS | Disperse Red 177 | SC |
| Samaron Red 2BSL | Disperse Red 184 | No |
| Resolin Red F3RS | Not Available | No |
| Sodyecron Violet B5R | Not Available | No |
| Foron Brilliant Violet S3RL | Not Available | No |
| Genacron Violet RB | Not Available | No |
| Latyl Violet 2R | Disperse Violet 18 | No |
| Latyl Bordeaux B | Disperse Violet 26 | No |
| Samaron Violet HFRL | Disperse Violet 31 | No |
| | Disperse Violet 36 | No |
| Resolin Rubine BL | Disperse Violet 40 | No |
| Samaron Violet 4RS | Disperse Violet 48 | No |
| | Disperse Violet 63 | No |
| Bucron Navy Blue G | Not Available | Yes |
| Sodyecron Navy Blue CCLS | Not Available | Yes |
| Resolin Navy Blue TPS | Not Available | Yes |
| Resolin Dark Blue NL | Not Available | Yes |
| Dispersol Blue BG Grains | Disperse Blue 26 | No |
| Eastman Polyester Blue GLF | Disperse Blue 27 | No |
| Dispersol Blue BT Grains | Disperse Blue 35 | No |
| Resolin Blue FBL | Disperse Blue 56 | No |
| Latyl Brilliant Blue BGA | Disperse Blue 60 | No |
| Foron Blue SBGL | Disperse Blue 73 | No |
| Foron Navy Blue S-2GL | Disperse Blue 79 | Yes |
| Resolin Blue GRL | Disperse Blue 81 | No |

TABLE II-continued pH Sensitivity of Disperse Dyestuffs

| Dyestuff Common Tradename | C.I. If Available | Sensitivity |
|---|---|---|
| Resolin Dark Blue BL New | Similar to Blue 81 | No |
| Palanil Brilliant Blue F | Disperse Blue 87 | No |
| Palanil Navy Blue RE | Disperse Blue 94 | Yes |
| Samaron Blue HBL | Disperse Blue 95 | No |
| Eastman Polyester Blue GBT | Disperse Blue 118 | No |
| Dispersol Navy Blue D-2G Grains | Disperse Blue 122 | Yes |
| Resolin Navy Blue GLS | Disperse Blue 139 | Yes |
| Samaron Blue H3R | Disperse Blue 152 | No |
| Resolin Blue FR | Disperse Blue 154 | No |
| Resolin Blue BBLS | Disperse Blue 165 | Yes |
| Resolin Blue BEL | Not Available | No |
| Bucron Black KB | Not Available | Yes |
| Foron Black SK | Not Available | Yes |
| Resolin Black LE | Not Available | No |
| Mayester Black 4R | Not Available | Yes |
| Dispersol Green C-6B | Disperse Green 9 | No |
| Foron Brown S-3R | Disperse Brown 1 | Yes |

With respect to the disperse dyestuffs that are suitable for use according to teachings of the present invention, the dyestuffs that hydrolize at a pH higher than 5.0 are not suited, and those that undergo shade change not due to hydrolysis must be used subject to the shade change.

All fiber reactive dyes that have been tested have been deemed operable in the one bath process of the present invention, with the minor exception of a few of the dyestuffs that are sensitive to electrolyte content, such as Levafix Blue EB. Varying degrees of success are achieved depending upon the particular parameters of the process employed. Such of course led to the segregation of the fiber reactive dyestuffs into the five groups. Fiber reactive dyestuffs that have worked best in the one bath system have been those formed by reaction of cyanuric chloride to form a derivative of same. Even derivatives of cyanuric chloride, however, react differently depending upon the molecular configuration and thus fall into the various groups, requiring differing amounts of electrolyte and alkali to achieve optimum results.

Group A fiber reactive dyestuffs include the following:

difluoropyrimidine

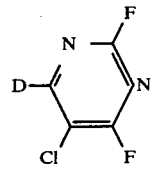

and dichloroquinoxaline

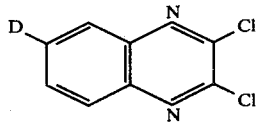

which structures are exemplified by Levafix Brilliant Yellow E3G (reactive yellow 25), Levafix G Yellow EG (reactive yellow 27), Levafix Scarlet E2GA (reactive red 123), and Levafix Brilliant Red E6BA.

In addition to the structures set forth above, group A also includes selected dyes from the formulations having the basic structures:
monochlorotriazine

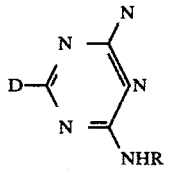

and trichloropyramidine

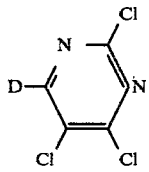

exemplified by Cibacron Brilliant Yellow GE (reactive yellow 81) Intracron Brilliant Yellow GE (reactive yellow 81), Procion Brilliant Yellow HE6G, and Procion Yellow HE4R.

Group B fiber reactive dyestuffs include Group A dyestuffs and the following:
dichlorotriazine

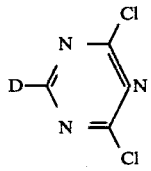

as exemplified by Procion Scarlet MX-BRA, Procion Red MX-5B (Reactive Red 2), Procion Red MX-G, and Procion Orange MX-2R (Reactive Orange 4), and Procion Red MX-GBA.

Fiber reactive dyes may fall into groups, B, C or D having the basic structures of monochlorotriazine and trichloropyrimidine (set forth above), as exemplified by Procion Red H8BN (reactive red 58), Cibacron Golden Yellow RE (reactive yellow 70), Cibacron Brilliant Red 4GE (reactive red 120), Cibacron Navy Blue 2RE (reactive blue 137), and Cibacron Scarlet 2GE (reactive red 43).

In particular, while any of the dyestuffs having the C and E groupings may be dyed with the electrolyte content and alkali system specified for group B, optimum results may not be attained. For example, the group E dyes will not provide a maximum yield, though as set forth above, the yield can be improved by the second step of the process, i.e., the reduction in temperature and further addition of alkali to the dye bath. A particular dyestuff falling in the group C category is Cibacron Navy Blue 2RE (reactive blue 137). The group C dyestuffs are in general not recommended for light shades, since the chance for unlevel dyeing due to high alkali content would be increased.

As to the group D dyes, same can be dyed with the electrolyte and alkali systems of groups A or B since the dyestuffs exhaust quite readily with small amounts of electrolyte and alkali. The B group technique is, however, most preferred initially to obtain maximum yield in the heavier shades, and although the colors will exhaust with a high yield, the dyestuff is not fixed very well to the substrate. If, for example, the dyed material is soaped above 160° F., the amount of color that will come off the fiber increases as the temperature of the soaping increases, with the further possibility of latent crocking or bleeding. Most of the fiber reactive dyes in group D contain a copper phthalocyanine grouping as exemplified by reactive blue 7, Levafix Turquoise Blue EG (reactive blue 21), Remazol Turquoise P (reactive blue 21), Procion Turquoise HA (reactive blue 71), Drimarene Green X-3G (reactive green 12), and Cibacron Brilliant Green T-3GE (reactive green 12). The Remazol Turquoise P is not a true vinyl sulfone or B-sulfatoethylsulfone. As mentioned above, though a good exhaustion yield is attained with initial dye bath, the subsequent alkaline system addition is performed in a preferred situation to obtain maximum fixation of the dyestuff. In fact, the process for the group D dyes according to the present invention enables one to obtain levelness, yield, and fixations heretofore practically unattainable.

The group E fiber reactive dyes are basically the vinyl sulfone or B-sulfatoethylsulfone dyestuffs as generally exemplified by the Remazols, though as mentioned above occasionally a Remazol is not truly a vinyl sulfone or B-sulfatoethylsulfone and thus falls into a different group.

After Scour. Once the proper shade is obtained in the dyeing process, the bath is cooled and rinsed either by overflow rinse, drop-refill, or partial drop-refill. The goods are rinsed until the dye liquor is somewhat clear, and the bath is set at a temperature in a range of from about 120° to about 140° F., and after scour materials are added which preferably includes one or more particular scouring agents for the particular dyestuffs employed, most preferably highly anionic in nature. While the particular after-scour agents are not critical, obviously those used should be selected with consideration of the shade dyed, and the propensity of the after scour to foam. Suitable candidates for after scour agents include without limitation, Triethanolamines, soap, amine condensates, nonyl phenols, phosphated nonyl phenols and dodecyl benzene sulfonic acid compounds. Preferably, the after scours for use in the present process are blends of a neutralized free acid form of a 9-mole ethylene oxide nonylphenol, isopropylamine dodecyl benzene sulfonic acid, 9-mole ethylene oxide nonylphenol, and a soap which is the reaction product of a fat of a distilled coconut oil with oleic acid and potassium hydroxide. In the jet dyeing situation, the after scour should of course have a low foaming propensity, and preferably is a blend of a soap that is a reaction product of a fat of a distilled coconut oil with oleic acid and potassium hydroxide, isopropyl alcohol, a glycol, and a low foaming polyoxypropylene/polyoxyethylene condensate having a low HLB rating. Subsequent to addition of after scour agents which according to the present invention are preferably added in an amount in a range of from about 0.5 to about 2.0 weight percent of the material being dyed, the bath is heated to a temperature in a range of about 160° to about 212° F. (depending upon the depth of shade), run for about 15 to about 20 minutes, cooled, and rinsed well until clear. Softeners, fixatives or the like may then be applied to the material according to conventional methods, or the dye vat may be unloaded and the dyed material further handled as desired.

Of the reactive dye groupings, all of the group A fiber reactive dyes can be processed by the procedures set forth for the group B dyestuffs with increased wet fastness resulting. Techniques set forth for the group B dyestuffs is considered to be generally preferred for a majority of the fiber reactives with exceptions noted below. Procedures for dyeing group C are preferably utilized for dark shades, for example, navy, wine, black and the like. Procedures for group D dyes preferably are utilized only when turquoise and kelly greens (group D) are dyed with colors such as reactive blue 21, reactive blue 71, reactive green 12 and the like, and with procedures for group E dyestuffs preferably being utilized to obtain certain bright shades as a last resort. In the event that dyestuffs from two or more groups of rectives are employed, the procedure followed is preferably that for the most critical of the groups. Example 43 (below) utilizes groups B and C dyestuffs. Preferred procedure for group C reactives was employed to achieve better yield for the group C dye component. In like manner, Example 47 (below) employed group A and D reactives, and procedure for group D was followed.

EXAMPLES

The following specific examples will enable one skilled in the art to better understand the most preferred procedures for the various groups of dyestuffs for both beck and jet dyeing to achieve bright, medium and dark shades.

In all of the examples, a 50/50 polyester-cotton fabric was utilized with either a prescour for dull or dark colors within each of the shade ranges, and a prescour and bleach for pastel and bright colors within the various shade regions. Prescour operations included setting the bath at a proper water level and heating to 100° F. after which, two to three percent of Necco-Scour KX, a blend of sodium metasilicate, the free acid form of a phosphated 9-mole ethyleneoxide nonylphenol neutralized with potassium hydroxide, butyl cellosolve, orthodichlorobenzene, orthochlorotoluene, and dodecyl benzene sulfonic acid, manufactured by Neal Chemical Company, Rock Hill, S.C.; and 1 percent soda ash were added to the scour bath. The bath was heated to a temperature of 200°–212° F., and run for 30 to 45 minutes, after which the sample was tested for proper wet out. Thereafter, the bath was cooled and the fabric was rinsed well to remove residual alkali.

For those examples that included prescour and bleach, the bath was set at a proper water level and heated to 100° F., after which 2 to 3 percent Necco-Scour KX was added. The bath was then heated to 120° F., and run for 10 minutes, after which 1.00 gram per liter of Necco-Stabilizer ESS, a weakly anionic free flowing aminoplast dispersion supplied by Neal Chemical Company, Rock Hill, S.C., 1.50 grams per liter of a 50 percent solution of caustic soda, and 5.00 grams per liter of a 35 percent solution of hydrogen peroxide were added to the bath. The bath was then heated to a temperature in the range of 200°–212° F., run 30 to 45 minutes, and sampled to test fabric wet out. Thereafter the bath was cooled and the fabric was rinsed well to remove residual alkali.

Subsequent to the prescour or prescour and bleach operation, each example included an acid sour step, where the machine was set at the proper water level, the water was heated to 100° F. as fast as possible, and 1 to 2 percent of a 56 percent solution of acetic acid was added. The bath was then heated to 120° F. and run for 10 minutes, after which a water sample was taken and tested for pH to verify a range of about 5.5 to about 6.0. In like fashion, the pH of the fabric was checked and determined to be slightly on the acid side. Rapid testing of the pH of both the fabric and the water was achieved with Necco-Indicator OBS, an indicator solution manufactured by Neal Chemical Company.

When the pH of the bath and fabric were proper, the liquid was dropped from the vat and the vat refilled at a low water level at a temperature of about 80° to about 120° F.

Chlorine content of the water was then checked with Necco-Chlorine Indicator, an indicator solution supplied by Neal Chemical Company to determine the absence of chlorine. In those situations where chlorine was present, 100 to 150 grams of sodium thiosulfate were added to the bath per 2,000 gallons of water, and the bath was rechecked for chlorine.

Since a polyester cotton blend was being dyed, a dye carrier and a dye assist were added to the dye bath. For beck dyeing, 1.0 to 3.0 weight percent of Necco-Dye Assist DFR (Neal Chemical Company), a blend anionic surface active agent of a sulfate oil; triethanolamine; a soap of a distilled coconut oil, oleic acid and potassium hydroxide; isopropyl alcohol; sulfonated castor oil; an amine condensate of coconut oil; a phosphated 9-mole ethylene oxide nonylphenol neutralized with potassium hydroxide; and polyethylene glycol 400-SO, and 3.0 to 10.0 weight percent of Necco-Carrier OBS-7, a blend of trichlorobenzene, methyl paratoulate benzoate, methyl benzoate, isopropylamine dodecyl benzene sulfonic acid a phosphated 9-mole ethylene oxide nonyl phenol neutralized with potassium hydroxide, isopropyl alcohol, triethanolamine, and polyoxyethylene lauryl alcohol of PEG ether manufactured by Neal Chemical Company were added to the dye bath. For the jet dyeing examples, 1.00 to 3.00 weight percent of Necco-Dye Assist JDT, an anionic low foaming blend of the same ingredients as specified by Necco Dye Assist DFR, and 2.0 to 4.0 weight percent of Necco-Carrier OB-J, a blend of the same ingredients as specified for Necco Carrier OBS-7 with different ratios were added to the bath. Dye assists were added at an amount of 1.0 percent for light shades, 2.0 percent for medium shades and 3.0 percent for dark shades for both beck and jet examples. Carriers were added for light, medium, and dark shades in amounts of 3.0 percent, 7.0 percent and 10.0 percent respectively (beck) and 2.0 percent, 3.0 percent and 4.0 percent respectively (jet).

Alkaline ingredients and electrolyte were added to the dye bath as indicated in Table III to achieve the desired pH, total alkalinity and electrolyte concentration for the particular group of dyestuffs being utilized. As to each, however, the particular alkali system selected was dissolved in 100 to 150 gallons of water at a temperature of 140° to 160° F. and added very slowly to the dye bath. Thereafter, the electrolyte either glauber's salt (sodium sulfate) or common salt (sodium chloride), was added to the dye bath in quantities as set forth below in Table III.

Dye formulations as specified in Table III, were added in all examples as follows. The dispersed dyes were mixed in water at a temperature of 100° to 115° F. with care not to have the water temperature any higher than 115° F. After thorough mixing, the dye solution was added to the dye bath. Thereafter, 5 to 10 grams of sodium thiosulfate were added to 50 to 100 gallons of water at a temperature of 160 to 180 degrees F., and a test was run for the presence of chlorine. Once chlorine was determined to be absent from the bath, the particular fiber reactive dyestuffs were well dissolved in the water and the solution was added to the dye bath.

For both beck and jet dyeing, the dye bath was run at 80° F. for 20 minutes, after which the temperature was raised to 120° F. and pH and electrolyte content were tested. Thereafter for beck dyeing, the dye bath was raised at a rate of 2° F. per minute to the boil and run for one hour, whereas with jet dyeing the temperature was raised at 2° to 3° F. per minute to 250° F. and run for 30 minutes.

At the end of the specified run time for both beck and jet dyeing, the steam was turned off and the fabric was sampled to determine whether the proper dye shade had been achieved. If so, the bath was cooled, the bath dropped and refilled to rinse the fabric until the bath was somewhat clear, at which time the bath was set at a temperature of 80° to 120° F. and the material after scoured. For jet dyeing, 0.5 to 2.0% weight percent (0.5 percent for light shades, 1.0 percent for medium shades and 2.0 percent for dark shades) of Necco-Scour JTA, (Neal Chemical Company, Rock Hill, S.C.), a low foaming blend of a soap formed from a reaction of a fat of a distilled coconut oil with oleic acid and potassium hydroxide, isopropyl alcohol, a glycol, and a low foaming polyoxypropylene/polyoxyethylene condensate having a low HLB rating, was added the bath and the bath heated to a temperature in the range of 190° to 212° F., and run for 15 to 20 minutes, after which the bath was cooled and rinsed until clear. The fabric was then unloaded. For beck dyeing, a Necco-Scour AFR (Neal Chemical Company) was added in an amount of 0.50 to 2.0 weight percent (0.5 percent for light shades, 1.0 percent for medium shades, and 2.0 percent for dark shades), Necco-Scour AFR being a highly anionic blend of the free acid form of a 9-mole ethylene oxide nonylphenol which has been neutralized with potassium hydroxide, isopropylamine dodecyl benzene sulfonic acid, 9-mole ethylene oxide nonylphenol, and a soap which is a reaction of a fat of a distilled coconut oil with oleic acid and potassium hydroxide.

At the end of the dye cycle, in those cases where the shade was not as desired, the dye bath was cooled to 160° F. and further dye formulation mixed as described above was added to the bath, after which the bath was run for about 15 minutes, reheated at a rise rate of about 2° F. per minute to approximately 212° F. and run for 20 additional minutes. Prior to the reheating step, pH and electrolyte content were rechecked and, if out of the specified range, further alkali and electrolyte were added to the bath to return the pH and electrolyte content to the desired levels.

Good exhaustion yields and dye fastness were obtained for both the group A, B and C dyestuffs. For group E dyestuffs, however, a low yield was initially obtained. For those particular examples, subsequent to the first dyeing, temperature of the dye bath was reduced to a temperature of approximately 160° F., at which point, about 10.0 grams per liter of soda ash and about 1.5 grams per liter of a 50 percent solution of caustic soda were added to the bath, followed by about thirty minutes run time. With the subsequent addition of alkali, high yield and fastness were obtained.

The same general subsequent alkali addition procedure was utilized for the group D dyestuffs where, though a good yield was initially obtained in the dyeing operation, the dye was not wet fast. For group D dyestuffs, bath temperature was lowered to 180° F., 15 grams per liter of soda ash and one gram per liter of a 50 percent solution of caustic soda were added to the bath and run continued for about 30 minutes. Subsequent to the second alkaline system addition, the dyestuff was wet fast as intended.

In all of the Examples commercially acceptable, level dyeings were obtained with good wet fastness.

TABLE III

One Bath Dyeing of Polyester/Cotton Fabrics

| EXAMPLE NO. | PRETREATMENT[1] | SHADE[2] | DYE PROCESS | ALKALI[3] SYSTEM, g/l | pH | ELECTROLYTE[4], g/l | Dyestuff Formulation: DISBURSE | Dyestuff Formulation: FIBER REACTIVE | DYE GROUP |
|---|---|---|---|---|---|---|---|---|---|
| 1 | S/B | L/B | JET | 0.3 S.A.<br>1.0 Bicarb. | 9.0 | 120 G. Salt | 0.15% A. Yel. 4RL (23)<br>0.08% A. Yel. L3G (54) | 0.20% L. Brill. Yel. E3G (R25)<br>0.13% L. Gold. Yel. EG (R27) | A |
| 2 | S | L/D | JET | 0.3 S.A.<br>1.0 Bicarb. | 9.0 | 120 G. Salt | 0.15% A. Yel. 4RL (23)<br>0.08% A. Yel. L3G (54) | 0.20% L. Brill. Yel. E3G (R25)<br>0.13% L. Gold. Yel. EG (R27) | A |
| 3 | S/B | M/B | JET | 0.3 S.A.<br>1.0 Bicarb. | 9.0 | 120 G. Salt | 0.40% R. Yel. 4GL (54)<br>0.60% R. Red F3BS | 1.30% L. Brill. Scar. E2GA (R123)<br>0.30% L. Red E6BA | A |
| 4 | S | M/D | JET | 0.3 S.A.<br>1.0 Bicarb. | 9.0 | 120 G. Salt | 0.40% R. Yel. 4GL (54)<br>0.60% R. Red F3BS | 1.30% L. Brill. Scar. E2GA (R123)<br>0.30% L. Red E6BA | A |
| 5 | S/B | D/B | JET | 0.3 S.A.<br>1.0 Bicarb. | 9.0 | 120 C. Salt | 2.00% R. Yel. GSL<br>5.00% A. Red YLS | 4.00% L. Brill. Scar. E-2GA (R123) | A |
| 6 | S | D/D | JET | 0.3 S.A.<br>1.0 Bicarb. | 9.0 | 120 C. Salt | 2.00% R. Yel. GSL<br>5.00% A. Red YLS | 4.00% L. Brill. Scar. E-2GA (R123) | A |
| 7 | S/B | L/B | JET | 2.0 S.A.<br>1.0 Bicarb. | 9.0 | 140 C. Salt | 0.10% A. Yel. 4RL (23)<br>0.05% A. Yel. L3G (54) | 0.23% C. Yel. RA (R3)<br>0.15% C. Yel. GE (R81) | B |
| 8 | S | L/D | JET | 2.0 S.A.<br>1.0 Bicarb. | 9.0 | 140 C. Salt | 0.10% A. Yel. 4RL (23)<br>0.05% A. Yel. L3G (54) | 0.23% C. Yel. RA (R3)<br>0.15% C. Yel. GE (R81) | B |
| 9 | S/B | M/B | JET | 2.0 S.A.<br>1.0 Bicarb. | 9.0 | 140 C. Salt | 0.20% A. Yel. 4RL (23)<br>0.10% A. Yel. L3G (54) | 0.46% C. Yel. RA (R3)<br>0.36% C. Brill. Yel. GE (R81) | B |
| 10 | S | M/D | JET | 2.0 S.A.<br>1.0 Bicarb. | 9.0 | 140 G. Salt | 0.40% R. Yel. 4GL (54)<br>0.60% R. Red. F3BS | 1.30% L. Brill. Scar. E-2GA (R123)<br>0.30% L. Red E-6BA | B |
| 11 | S/B | D/B | JET | 2.0 S.A.<br>1.0 Bicarb. | 9.0 | 140 C. Salt | 0.08% R. Blue FBL (56)<br>0.35% T. Ora. 2GR (25)<br>2.10% F. Rub. SE-GFL (73) | 0.80% L. Gold. Yel. EG (R27)<br>3.40% L. Brill. Red E-6BA<br>0.40% L. Black EB (R5) | B |
| 12 | S | D/D | JET | 2.0 S.A.<br>1.0 Bicarb. | 9.0 | 140 C. Salt | 2.00% R. Yel. GSL<br>5.00% A. Red YLS | 4.00% L. Brill. Scar. E-2GA (R123) | B |
| 13 | S/B | M/B | JET | 5.5 S.A.<br>1.5 Bicarb. | 10.0 | 140 G. Salt | 2.00% R. Blue FBL (56)<br>0.10% R. Yel. 4GL (54)<br>0.10% R. Brill. Red FB (60) | 2.00% C. Navy Blue 2RE (R137)<br>0.20% C. Brill. Yel. GE (R81) | C |
| 14 | S | M/D | JET | 5.5 S.A.<br>1.5 Bicarb. | 10.0 | 140 G. Salt | 2.00% R. Blue FBL (56)<br>0.10% R. Yel. 4GL (54)<br>0.10% R. Brill. Red FB (60) | 2.00% C. Navy Blue 2RE (R137)<br>0.20% C. Brill. Yel. GE (R81) | C |
| 15 | S/B | D/B | JET | 5.5 S.A.<br>1.5 Bicarb. | 10.0 | 140 G. Salt | 0.40% A. Yel. L3G (54)<br>3.00% T. Dk. Blue RB (55) | 0.80% C. Blue TRE<br>0.14% C. Brill. Yel. GE (R81)<br>2.50% C. Na. Blue 2RE (R137) | C |
| 16 | S | D/D | JET | 5.5 S.A.<br>1.5 Bicarb. | 10.0 | 140 G. Salt | 0.40% A. Yel. L3G (54)<br>3.00% T. Dk. Blue RB (55) | 0.80% C. Blue TRE<br>0.14% C. Brill. Yel. GE (R81)<br>2.50% C. Na. Blue 2RE (R137) | C |
| 17 | S/B | L/B | JET | 2.0 S.A.<br>1.5 Bicarb. | 8.5 | 140 G. Salt | 0.25% D. Green C6B (9)<br>0.35% R. Yel. 4GL (54) | 1.00 L. Turq. Blue EG (R21)<br>0.60 L. Brill. Yel. E3G (R25) | D |
| 18 | S | L/D | JET | 2.0 S.A.<br>1.5 Bicarb. | 8.5 | 140 G. Salt | 0.25% D. Green C6B (9)<br>0.35% R. Yel. 4GL (54) | 1.00% L. Turq. Blue EG (R21)<br>0.60 L. Brill. Yel. E3G (R25) | D |
| 19 | S/B | M/B | JET | 2.0 S.A.<br>1.5 Bicarb. | 8.5 | 140 C. Salt | 0.50% D. Green C6B (9)<br>0.70% R. Yel. 4GL (54) | 3.00% P. Brill. Yel. HE-6G<br>0.02% P. Yel. HE4R<br>1.20% P. Turq. HA (R71) | D |
| 20 | S | M/D | JET | 2.0 S.A.<br>1.5 Bicarb. | 8.5 | 140 C. Salt | 0.50% D. Green C6B (9)<br>0.70% R. Yel. 4GL (54) | 3.00% P. Brill. Yel. HE-6G<br>0.02% P. Yel. HE4R<br>1.20% P. Turq. HA (R71) | D |
| 21 | S/B | D/B | JET | 2.0 S.A. | 8.5 | 140 C. Salt | 0.13% T. Brill. Bl. 3RL (56) | 3.60% Di. Green X3G (R12) | D |

TABLE III-continued

One Bath Dyeing of Polyester/Cotton Fabrics

| EXAMPLE NO. | PRETREATMENT[1] | SHADE[2] | DYE PROCESS | ALKALI[3] SYSTEM, g/l | pH | ELECTROLYTE[4], g/l | Dyestuff Formulation: DISBURSE | Dyestuff Formulation: FIBER REACTIVE | Dyestuff Formulation: DYE GROUP |
|---|---|---|---|---|---|---|---|---|---|
| | | | | 1.5 Bicarb. | | | 0.46% T. Yel. 2GW (54)<br>2.50% T. Brill. Blue BGA (60) | 0.40% C. Blue TRE | |
| 22 | S | D/D | JET | 2.0 S.A.<br>1.5 Bicarb. | 8.5 | 140 C. Salt | 0.13% T. Brill. Bl. 3RL (56)<br>0.46% T. Yel. 2GW (54)<br>2.50% T. Brill. Bl. BGA (60) | 3.60 Di. Green X3G (R12)<br>0.40% C. Blue TRE | D |
| 23 | S/B | L/B | JET | 5.5 S.A.<br>1.5 Bicarb. | 10.0 | 140 C. Salt | 0.75% R. Brill. Red FB (60)<br>0.02% R. Blue FBL (56) | 1.00% Rem. Brill. Red BB | E |
| 24 | S | L/D | JET | 5.5 S.A.<br>1.5 Bicarb. | 10.0 | 140 C. Salt | 0.75% R. Brill. Red FB (60)<br>0.02% R. Blue FBL (56) | 1.00% Rem. Brill. Red BB | E |
| 25 | S/B | M/B | JET | 5.5 S.A.<br>1.5 Bicarb. | 10.0 | 140 C. Salt | 0.03% F. Ora. ERL (25)<br>0.02% R. Brill. Red FB (60)<br>1.00% A. Brill. Blue BL (56) | 2.00% Rem. Blue BR | E |
| 26 | S | M/D | JET | 5.5 S.A.<br>1.5 Bicarb. | 10.0 | 140 C. Salt | 0.03% F. Ora. ERL (25)<br>0.02% R. Brill. Red FB (60)<br>1.00% A. Brill. Blue BL (56) | 2.00% Rem. Blue BR | E |
| 27 | S/B | D/B | JET | 5.5 S.A.<br>1.5 Bicarb. | 10.0 | 140 C. Salt | 0.40% La. Yel. GFSW (67)<br>3.00% La. Cerise NSN<br>0.09% R. Blue FBL (56) | 6.00% Rem. Rubine GR | E |
| 28 | S | D/D | JET | 5.5 S.A.<br>1.5 Bicarb. | 10.0 | 140 C. Salt | 0.40% La. Yel. GFSW (67)<br>3.00% La. Cerise NSN<br>0.09% R. Blue FBL (56) | 6.00% Rem. Rubine GR | E |
| 29 | S/B | L/B | BECK | 0.3 S.A.<br>1.0 Bicarb. | 9.0 | 120 G. Salt | 0.15% A. Yel. 4RL (23)<br>0.08% A. Yel. L3G (54) | 0.20% L. Brill. Yel. E3G (R25)<br>0.13% L. Gold. Yel. EG (R27) | A |
| 30 | S | L/D | BECK | 0.3 S.A.<br>1.0 Bicarb. | 9.0 | 120 G. Salt | 0.15% A. Yel. 4RL (23)<br>0.08% A. Yel. L3G (54) | 0.20% L. Brill. Yel. E3G (R25)<br>0.13% L. Gold. Yel. EG (R27) | A |
| 31 | S/B | M/B | BECK | 0.3 S.A.<br>1.0 Bicarb. | 9.0 | 120 G. Salt | 0.90% A. Red FB (60)<br>0.50% T. Ora. 2GR (25) | 0.75% L. Scar. E2GA (R123)<br>0.25% L. Brill. Red E6BA | A |
| 32 | S | M/D | BECK | 0.3 S.A.<br>1.0 Bicarb. | 9.0 | 120 G. Salt | 0.90% A. Red FB (60)<br>0.50% T. Ora. 2GR (25) | 0.75% L. Scar. E2GA (R123)<br>0.25% L. Brill. Red E6BA | A |
| 33 | S/B | D/B | BECK | 0.3 S.A.<br>1.0 Bicarb. | 9.0 | 120 C. Salt | 0.08% R. Blue FBL (56)<br>0.35% T. Ora. 2GR (25)<br>2.10% F. Rub. SE-GFL (73) | 0.80% L. Gold. Yel. EG (R27)<br>3.40% L. Brill. Red E-6BA<br>0.25% L. Black EB (R5) | A |
| 34 | S | D/D | BECK | 0.3 S.A.<br>1.0 Bicarb. | 9.0 | 120 C. Salt | 0.08% R. Blue FBL (56)<br>0.35% T. Ora. 2GR (25)<br>2.10% F. Rub. SE-GFL (73) | 0.80% L. Gold. Yel. EG (R27)<br>3.40% L. Brill. Red E-6BA<br>0.25% L. Black EB (R5) | A |
| 35 | S/B | L/B | BECK | 2.0 S.A.<br>1.0 Bicarb. | 9.0 | 140 C. Salt | 0.10% A. Yel. 4RL (23)<br>0.05% A. Yel. L3G (54) | 0.23% C. Yel. RA (R3)<br>0.15% C. Yel. GE (R81) | B |
| 36 | S | L/D | BECK | 2.0 S.A.<br>1.0 Bicarb. | 9.0 | 140 C. Salt | 0.10% A. Yel. 4RL (23)<br>0.05% A. Yel. L3G (54) | 0.23% C. Yel. RA (R3)<br>0.15% C. Yel. GE (R81) | B |
| 37 | S/B | M/B | BECK | 2.0 S.A.<br>1.0 Bicarb. | 9.0 | 140 C. Salt | 1.30% T. Ora. 2RL<br>0.06% A. Red FB (60) | 1.40% P. Ora. MX-2R (R4)<br>0.06% P. Red MX-GBA | B |
| 38 | S | M/D | BECK | 2.0 S.A.<br>1.0 Bicarb. | 9.0 | 140 G Salt | 1.80% A. Red FB<br>1.00% T. Ora. 2GR | 1.50% P. Red MX-5B<br>2.50% P. Ora. MX-2R (R4) | B |
| 39 | S/B | D/B | BECK | 2.0 S.A.<br>1.0 Bicarb. | 9.0 | 140 C. Salt | 2.10% A. Red FB (60)<br>1.00% T. Ora. 2GR (25) | 1.20% C. Brill. Red 4GE (R120)<br>2.00% C. Scar. 2GE (R43) | B |
| 40 | S | D/D | BECK | 2.0 S.A.<br>1.0 Bicarb. | 9.0 | 140 C. Salt | 0.08% R. Blue FBL (56)<br>0.35% T. Ora. 2GR (25)<br>2.10% F. Rub. SE-GFL (73) | 0.80% L. Gold. Yel. EG (R27)<br>3.40% L. Brill. Red E-6BA<br>0.40% L. Black EB (R5) | B |

TABLE III-continued

One Bath Dyeing of Polyester/Cotton Fabrics

| EXAMPLE NO. | PRETREATMENT[1] | SHADE[2] | DYE PROCESS | ALKALI[3] SYSTEM, g/l | pH | ELECTROLYTE[4], g/l | Dyestuff Formulation: DISBURSE | Dyestuff Formulation: FIBER REACTIVE | Dyestuff Formulation: DYE GROUP |
|---|---|---|---|---|---|---|---|---|---|
| 41 | S/B | M/B | BECK | 5.5 S.A.<br>1.5 Bicarb. | 10.0 | 140 C. Salt | 2.00% R. Blue FBL (56)<br>0.10% R. Yel. 4GL (54)<br>0.10% R. Brill. Red FB (60) | 2.00% C. Na. Blue 2RE (R137)<br>0.20% C. Brill. Yel. GE (R81) | C |
| 42 | S | M/D | BECK | 5.5 S.A.<br>1.5 Bicarb. | 10.0 | 140 C. Salt | 2.00% R. Blue GRL (81)<br>0.08% R. Brill. Red FB (60) | 2.00% C. Na. Blue TRE (R137) | C |
| 43 | S/B | D/B | BECK | 5.5 S.A.<br>1.5 Bicarb. | 10.0 | 140 C. Salt | 0.08% A. Brill. Bl. BL (56)<br>0.35% T. Ora. 2GR (25)<br>2.10% R. Rub. SE-GFL (73) | 5.40% C. Brill. Red 4GE (R120)<br>0.60% C. Gold. Yel. RE (R70)<br>1.20% C. Navy Blue 2RE (R137) | C |
| 44 | S | D/D | BECK | 5.5 S.A.<br>1.5 Bicarb. | 10.0 | 140 C. Salt | 4.00% D. Na. Bl. BT Grains (35) | 0.80% C. Blue TRE<br>0.14% C. Brill. Yel. GE<br>2.50% C. Na. Bl. 2RE (R137) | C |
| 45 | S/B | L/B | BECK | 2.0 S.A.<br>1.5 Bicarb. | 8.5 | 140 G. Salt | 0.25% D. Green C6B (9)<br>0.35% R. Yel. 4GL (54) | 1.00% L. Turq. Bl. EG (R21)<br>0.60% L. Brill. Yel. E3G (R25) | D |
| 46 | S | L/D | BECK | 2.0 S.A.<br>1.5 Bicarb. | 8.5 | 140 G. Salt | 0.40% R. Blue FBL (56)<br>0.60% R. Yel. 4GL (54)<br>0.05% T. Ora. 2GR (25) | 0.80% Di. Green X3G (R12) | D |
| 47 | S/B | M/B | BECK | 2.0 S.A.<br>1.5 Bicarb. | 8.5 | 140 C. Salt | 0.50% D. Green C6B (9)<br>0.70% R. Yel. 4GL (54) | 3.00% P. Brill. Yel. HE-6G<br>0.02% P. Yel. HE4R<br>1.20% P. Turq. HA (R71) | D |
| 48 | S | M/D | BECK | 2.0 S.A.<br>1.5 Bicarb. | 8.5 | 140 C. Salt | 1.30% T. Brill. Blue BGA (60)<br>0.02% A. Red YLS | 2.00% P. Turq. HA (R71)<br>0.02% P. Yel. HE4R<br>0.06% P. Red H8BN (R58) | D |
| 49 | S/B | D/B | BECK | 2.5 S.A.<br>1.5 Bicarb. | 8.5 | 140 C. Salt | 0.13% T. Brill. Bl. 3RL (56)<br>0.46% T. Yel. 2GW (54)<br>2.50% T. Brill. Blue BGA (60) | 3.60% D. Green X3G (R12)<br>0.40% C. Blue TRE | D |
| 50 | S | D/D | BECK | 2.5 S.A.<br>1.5 Bicarb. | 8.5 | 140 C. Salt | 0.90% D. Green C6B (9)<br>1.40% A. Yel. L3G (54) | 1.00% P. Brill. Yel. HE6G<br>2.60% P. Turq. HA (R71)<br>0.30% P. Yel. HE4R | D |
| 51 | S/B | L/B | BECK | 5.5 S.A.<br>1.5 Bicarb. | 10.0 | 140 C. Salt | 0.75% R. Brill. Red FB (60)<br>0.02% R. Blue FBL (56) | 1.00% Rem. Brill. Red BB | E |
| 52 | S | L/D | BECK | 5.5 S.A.<br>1.5 Bicarb. | 10.0 | 140 C. Salt | 0.75% R. Brill. Red FB (60)<br>0.02% R. Blue FBL (56) | 1.00% Rem. Brill. Red BB | E |
| 53 | S/B | M/B | BECK | 5.5 S.A.<br>1.5 Bicarb. | 10.0 | 140 C. Salt | 0.03% F. Ora. ERL (25)<br>0.02% R. Brill. Red FB (60)<br>1.00% A. Brill. Bl. BL (56) | 2.00% Rem. Blue BR | E |
| 54 | S | M/D | BECK | 5.5 S.A.<br>1.5 Bicarb. | 10.0 | 140 C. Salt | 0.03% F. Ora. ERL (25)<br>0.02% R. Brill. Red FB (60)<br>1.00% A. Brill. Bl. BL (56) | 2.00% Rem. Blue BR | E |
| 55 | S | M/D | BECK | 5.5 S.A.<br>1.5 Bicarb. | 10.0 | 140 C. Salt | 0.40% La. Yel. GFSW (67)<br>3.00% La. Cerise NSN<br>0.09% R. Blue FBL (56) | 6.00% Rem. Rubine GR | E |
| 56 | S | D/D | BECK | 5.5 S.A.<br>1.5 Bicarb. | 10.0 | 140 C. Salt | 0.40% La. Yel. GFSW (67)<br>3.00% La. Cerise NSN | 6.00% Rem. Rubine GR | E |

TABLE III-continued

| | | | | One Bath Dyeing of Polyester/Cotton Fabrics | | | | | |
|---|---|---|---|---|---|---|---|---|---|
| | | | | | | | Dyestuff Formulation | | |
| EXAMPLE NO. | PRETREATMENT[1] | SHADE[2] | DYE PROCESS | ALKALI[3] SYSTEM, g/l | pH | ELECTROLYTE[4], g/l | DISBURSE | FIBER REACTIVE | DYE GROUP |
| | | | | | | | 0.09% R. Blue FBL (56) | | |

LEGEND FOR TABLE III
[1]S = scour only
S/B = scour and bleach
[2]L/B = Light shade/Bright
L/D = Light shade/Dull
M/B = Medium shade/Bright
M/D = Medium shade/Dull
D/B = Dark shade/Bright
D/D = Dark shade/Dull
[3]S.A = Soda Ash
Bicarb. = Sodium Bicarbonate
[4]G. Salt = Glauber Salt
C. Salt = Common Salt
Color Abbreviations and Trademark Abbreviations in dyestuff listings:
A. = Amacron
L. = Levafix
T. = Terasil
R. = Resolin
F. = Foron
C. = Cibacron
D. = Dispersol
P. = Procion
Di. = Drimarene
Rem. = Remazol
La. = Latyl
Yel. = Yellow
Brill. = Brilliant
Gold. = Golden
Scar. = Scarlet
Ora. = Orange
Rub. = Rubine
Turq. = Turquoise
numbers in ( ) = color index number

EXAMPLES 57–68

Examples 29–32 were repeated with the exception that the alkali system was changed. For each example, dyeing was also accomplished using 3 grams/liter borax; 1 gram/liter monosodium phosphate and 1 gram/liter soda ash; and 1.5 grams/liter sodium bicarbonate and 0.5 gram/liter tetrasodium pyrophosphate. In all cases, level dyeing resulting along with good wet fastness.

EXAMPLES 69–72

Example 39 was repeated with the exception that the alkali system was varied as follows: 2 grams/liter soda ash and 2 grams/liter borax; 2 grams/liter soda ash and 0.3 gram/liter monosodium phosphate; 2 grams/liter trisodium phosphate and 2 grams/liter Borax; and 2 grams/liter trisodium phosphate and 0.3 grams/liter monosodium phosphate. Like results were obtained.

EXAMPLES 73–76

Example 43 was repeated with the exception that the alkali system was varied as follows: 4 grams/liter soda ash and 1 gram/liter borax; 5 grams/liter soda ash and 1 gram/liter monosodium phosphate; 5 grams/liter trisodium phosphate and 1 gram/liter monosodium phosphate; and 4 grams/liter trisodium phosphate and 1 gram/liter borax. Like results were obtained.

A number of dyestuffs have been identified hereinabove by way of trademark. As such, the various marks used in conjunction with dyestuffs are identified as follows with the company manufacturing and/or marketing same. Bucron and Bucacel—Blackman—Uhler Chemical Company, Spartanburg, S.C.; Eastman—Eastman Chemical Company, Kingsport, Tenn.; Samaron and Remazol—American Hoechst Corporation, Charlotte, N.C.; Genacron and Palanil—BASF, Inc., Charlotte, N.C.; Esterophile—Francolor, Inc., Charlotte, N.C.; Sodyecron—Sodyeco, Inc., Mt. Holly, N.C.; Foron and Drimarene—Sandoz, Inc., Charlotte, N.C.; Mayester—Otto B. May Co., Charlotte, N.C.; Amacron—American Color and Chemicals Inc., Charlotte, N.C.; Levafix and Resolin—Verona, Divison of Mobay, Rock Hill, S.C.; Terasil and Cibacron—Ciba—Geigy, Inc., Greensboro, N.C.; Dispersol and Procion—Imperial Chemicals Industries, Inc., Charlotte, N.C.; and Latyl—E. I. duPont deNemours and Company, Charlotte, N.C.

Having described the present invention in detail, it is obvious that one skilled in the art will be able to make variations and modifications thereto without departing from the scope of the invention. Accordingly, the scope of the present invention should be determined only by the claims appended hereto.

That which is claimed is:

1. A one bath process for dyeing cellulosic containing textile materials with fiber-reactive dyestuffs comprising the steps of:

(a) preparing a dye bath which comprises a dye assist system that is stable to high electrolyte and alkali; from about 110 to about 160 grams of electrolyte per liter of bath; and a predetermined amount of alkaline material that permits proper exhaustion of dyestuff therefrom and level dyeing, said dye bath having a pH of from about 8.5 to about 12.5;

(b) adding a predetermined dyestuff formulation to the dye bath to achieve a predetermined shade, said dyestuff formula containing at least one fiber reactive dyestuff;

(c) subjecting said material to said dye bath at a predetermined time-temperature relationship to dye said material to said shade; and (d) thereafter rinsing and scouring said material.

2. The process as defined in claim 1 wherein the cellulosic containing material is cotton.

3. The process as defined in claim 1 wherein the cellulosic containing material is a blend of polyester-cotton and wherein the dyestuff formulation also comprises at least one disperse dyestuff for dyeing the polyester component, said dyestuff being of a type that does not hydrolyze at high pH, and a carrier system is added to the dye bath for the disperse dyestuff, said carrier system being stable to high electrolyte content and high pH.

4. The process as defined in claim 3 wherein the fiber reactive dyestuff is a group A type fiber reactive and wherein the electrolyte content in the dye bath is from about 110 to about 140 grams of electrolyte per liter of bath and pH of the bath is in a range of from about 8.3 to about 9.5.

5. The process as defined in claim 3 wherein the fiber reactive dyestuff is a group B fiber reactive and wherein the electrolyte content in the dye bath is from about 140 to about 160 grams of electrolyte per liter of bath and pH of the bath is in a range of from about 8.3 to about 10.5.

6. The process as defined in claim 3 wherein the fiber reactive dyestuff is a group C dyestuff and wherein electrolyte content in the bath is from about 140 to about 160 grams of electrolyte per liter of bath and pH of the bath is in a range of from about 8.8 to about 11.2.

7. The process as defined in claim 3 wherein the fiber reactive dyestuff is a group E reactive dyestuff and the electrolyte content in the dye bath is in a range of from about 140 to about 160 grams of electrolyte per liter of bath and pH of the dye bath is in a range of from about 10.0 to about 11.2, and further, following a normal dyeing time, the temperature of the dye bath is reduced to about 160° F., additional alkali is added to the bath adequate to exhaust said reactive dyestuffs, whereby improved exhaustion is obtained.

8. The process as defined in claim 3 wherein the fiber reactive dyestuff is a group D reactive dyestuff and wherein the electrolyte content in the dye bath is in a range of from about 140 to about 160 grams of electrolyte per liter of bath and pH of the bath is in a range of from about 8.3 to about 10.5, and further, following a normal dyeing time, temperature of the dye bath is reduced to about 180° F., additional alkali is added to the bath and running is continued for a predetermined time, whereby the dyestuff is fixed to the cellulosic component of the material resulting in improved wet fastness.

9. The process as defined in claim 1 wherein the material is also bleached in the scour operation.

10. A one bath process for dyeing polyester-cotton textile materials comprising the steps of:

(a) providing a dye bath;

(b) adding from about 0.5 to about 3.5 weight percent of a dye assist to the dye bath, said dye assist being an anionic blend of low forming surface reactive agents, said dye assist blend being stable to high electrolyte and high bath pH;

(c) adding from about 1.5 to about 12.0 weight percent of a disperse dye carrier to said dye bath, said carrier comprising from about 93 to about 70 weight percent solvent and fromabout 7 to about 30 weight percent emulsifier, said carrier being stable to high electrolyte content and high bath pH;

(d) adding alkali to the dye bath to provide a bath pH of from about 8.0 to about 12.5 and a total alkalinity at which appreciable alkaline hydrolysis is avoided in the presence of from about 110 to about 160 grams of electrolyte per liter of bath;

(e) adding to the dye bath from about 110 to about 160 grams of electrolyte per liter of bath;

(f) adding a predetermined dyestuff formulation to the dye bath to dye said polyester-cotton material to said desired shade, said dyestuff formulation comprising at least one disperse dyestuff that is stable against hydrolysis at a pH in a range of from about 8.0 to about 12.5 and at least one fiber reactive dyestuff;

(g) heating said dye bath to a temperature of from about 212° F. to about 250° F. and subjecting said material thereto for from about 30 to about 60 minutes until said desired shade is obtained; and (h) thereafter rinsing and scouring said material.

11. The process as defined in claim 10 wherein following the run time for initial dyeing, temperature of the dye bath is reduced to from about 160° to about 180° F., extra alkali is added thereto, and run time is continued for about 30 further minutes.

12. The process as defined in claim 10 wherein a bleaching agent is added during the first scour.

13. The process as defined in claim 10 wherein the dyestuff formulation contains a group A reactive dyestuff and wherein the dyeing is conducted at a batch pH of from about 8.0 to about 9.5, and electrolyte content in the bath is in a range of from about 110 to about 140 grams per liter.

14. The process as defined in claim 10 wherein the dyestuff formulation contains a group B reactive dyestuff and wherein dyeing is conducted at a bath pH of from about 8.3 to about 10.5 and electrolyte content in the bath is in a range of from about 140 to about 160 grams per liter.

15. The process as defined in claim 10 wherein the dyestuff formulation includes a group C reactive dyestuff and wherein dyeing is conducted at a bath pH in a range of from about 8.8 to about 11.2 and electrolyte content in the bath is in a range of from about 140 to about 160 grams per liter.

16. The process as defined in claim 11 wherein the dyestuff formulation includes a group D reactive dyestuff and wherein initial dyeing is conducted at a bath pH in a range of from about 8.3 to about 10.5 and electrolyte content in the bath is in a range of from about 140 to about 160 grams per liter, and wherein after initial dyeing, the temperature of the dye bath reduced to 180° F., from about 10.0 to about 15.0 grams per liter of soda ash and from about 0.5 to about 1.0 grams per liter of a 50 percent solution of caustic soda are added to the bath, and running is continued for a time adequate to provide improved dye wet fastness.

17. The process as defined in claim 11 wherein the dyestuff formulation includes a group E reactive dyestuff and wherein initial dyeing is conducted at a bath pH in a range of from about 10.0 to about 11.2 and electrolyte content in the bath is in a range of from about 140 to about 160 grams per liter, and wherein after initial dyeing, the temperature of the dye bath reduced to 160° F., and from about 7.5 to about 10.0 grams per liter of soda ash and from about 1.0 to about 1.5 grams per liter of a 50 percent solution of caustic soda are added to the bath, and running is continued for a time adequate to improve dye yield.

18. The process as defined in claim 10 wherein the dye carrier solvent component comprises a solvent blend of at least one solvent that swells the fiber, promoting good yield and at least one solvent that promotes leveling and migration.

19. The process as defined in claim 18 wherein the dye carrier emulsifier component comprises a blend of hydrophilic and lipophilic emulsifiers.

20. The process as defined in claim 10 wherein the electrolyte is a member selected from the group consisting of sodium chloride and sodium sulfate.

21. The process as defined in claim 10 wherein the alkali ingredient added to the dye bath is a mixture of ingredients selected from the group consisting of strong alkali, weak alkali and weak acids to achieve recited bath pH and total alkalinity.

22. The process as defined in claim 21 wherein bath pH and total alkalinity are maintained in the lower end of the recited ranges for same.

23. In a process for dyeing 100 percent cellulosic textile materials with fiber reactive dystuffs or polyester-cellulosic textile materials with pH stable disperse dyestuffs and fiber reactive dyestuffs, wherein the material to be dyed is prepared for dyeing and subjected to a dye bath containing a dyestuff formulation and auxiliaries therefor for a proper time-temperature arrangement, the improvement comprising selecting auxiliaries that are stable to high pH and high electrolyte content and maintaining pH of the dye bath in a range of from about 8.0 to about 12.5, total alkalinity of the bath in a range of from about 1 to about 8 grams of alkali per liter of bath, and providing an electrolyte content in a range of from about 110 to about 160 grams of electrolyte per liter of bath.

24. The process as defined in claim 23 wherein a group D or E fiber reactive dyestuff is employed and wherein after the normal dye cycle, bath temperature is reduced to a temperature in a range of from about 160° F. to about 180° F., further alkali is added thereto and the material is subjected to the high alkali bath for a further predetermined period of time whereby depending upon the group of fiber reactive dyestuff being used, improved yield or improved dye fastness results.

25. The process as defined in claim 23 wherein pH of the dye bath is maintained in a range of from about 8.3 to about 11.2.

26. A one bath process for dyeing cellulosic containing textile materials comprising the steps of:

(a) preparing a dye bath which comprises a dye assist system that is stable to high electrolyte and alkali; from about 110 to about 160 grams of electrolyte per liter of bath; and an amount of alkaline material that provides a bath pH in a range of from about 8.0 to about 12.5 while avoiding appreciable alkaline hydrolysis of a dyestuff being employed;

(b) adding a predetermined dyestuff formulation to the dye bath to achieve said shade, said dyestuff formulation containing at least one fiber reactive dyestuff;

(c) subjecting said cellulosic containing material to said dye bath at a time-temperature relationship such that level dyeing of the material is achieved without appreciable alkaline hydrolysis of said dyestuff;

(d) reducing bath temperature and adding further alkali to fix said dyestuff on said material and achieve improved wet fastness; and (e) thereafter rinsing and scouring said material.

* * * * *

UNITED STATES PATENT AND TRADEMARK OFFICE

CERTIFICATE OF CORRECTION

PATENT NO. : 4,359,322

DATED : November 16, 1982

INVENTOR(S) : Bobby L. Neal and Steven R. Lowman

It is certified that error appears in the above-identified patent and that said Letters Patent are hereby corrected as shown below:

Column 3, line 43, "overll" should read--overall--.

Column 3, line 66, "100" should read--110--.

Column 13, the formula for monochlorotriazine should appear as follows:

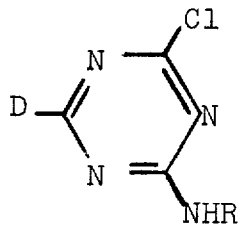

Column 29, line 2, "fromabout" should read--from about--.

Column 29, line 32, "batch" should read--bath--.

Signed and Sealed this

Eighth Day of February 1983

[SEAL]

Attest:

GERALD J. MOSSINGHOFF

Attesting Officer

Commissioner of Patents and Trademarks